United States Patent [19]

Ullman

[11] Patent Number: 4,475,653

[45] Date of Patent: Oct. 9, 1984

[54] PACKAGE AND PROCESS OF FORMING SAME

[75] Inventor: John E. Ullman, Huntingdon Valley, Pa.

[73] Assignee: The Mead Corporation, Dayton, Ohio

[21] Appl. No.: 434,439

[22] Filed: Oct. 14, 1982

Related U.S. Application Data

[63] Continuation-in-part of Ser. No. 683,611, May 5, 1976, , and Ser. No. 322,443, Nov. 18, 1981.

[51] Int. Cl.[3] ..... B65D 65/02; B65B 53/02

[52] U.S. Cl. ..... 206/497; 206/45.33; 206/432; 53/229; 53/329; 53/375; 53/379

[58] Field of Search ..... 206/45.33, 83.5, 432, 206/471, 497; 53/228, 229, 329, 344, 375, 379

[56] References Cited

U.S. PATENT DOCUMENTS

| | | | |
|---|---|---|---|
| 3,031,072 | 4/1962 | Kraut | 206/471 |
| 3,410,396 | 11/1968 | Copping | 206/497 |
| 4,036,362 | 7/1977 | Ullman | 206/497 |
| 4,094,406 | 6/1978 | Zietzchmann | 206/497 |

FOREIGN PATENT DOCUMENTS

| | | | |
|---|---|---|---|
| 691904 | 8/1964 | Canada | 206/432 |

*Primary Examiner*—William T. Dixson, Jr.
*Assistant Examiner*—Jimmy G. Foster
*Attorney, Agent, or Firm*—B. J. Powell

[57] ABSTRACT

A multi-unit package comprising a cellulosic tray with a group of articles in the tray and a flexible film sheet extending over the group of articles and overlapping the tray side walls where the film sheet has been first bonded to the outside of the tray side walls while leaving an unattached skirt portion between the first bond and the edge of the film sheet and where the unattached skirt portion has been heat bonded to the outside of the tray side walls subsequent to the first bond to cause the skirt portion to lie in juxtaposition with the outside of the tray side walls to enhance the effective transparency of the skirt portion. The method and apparatus for forming the package is also contemplated by the disclosure.

15 Claims, 17 Drawing Figures

10E
90
91
11
91
90
AT
95
95
34
dGP
94
98
98
94
124
112
115
125
AA
102
103
107
120
106
121
126
AH
101
105
104
116
AR
dSR
118
11
14
12
42
AL
DS
PP
98
96
96
98

PACKAGE AND PROCESS OF FORMING SAME

CROSS REFERENCE TO RELATED APPLICATIONS

This application is a continuation-in-part of my copending applications Ser. No. 683,611, filed May 5, 1976, and Ser. No. 322,443, filed Nov. 18, 1981.

BACKGROUND OF THE INVENTION

This invention relates generally to the packaging of articles such as cans, bottles and the like to make multi-unit packages and more particularly to the packaging of these articles by applying a sheet of film over a group of the articles in a paperboard tray, causing the film to bond to the tray by heating the film, or subsequently heat-shrinking the film to tightly hold the articles in the tray and make a unitary package.

Machines which package articles in paperboard trays by applying a sheet of film over the articles and bonding the film to the tray are known in the prior art. Such machines have been produced by Huntingdon Industries of Bethayres, Pennsylvania, under the trade names "WrapCap" and "PacCap" in accordance with the disclosure in my prior U.S. Pat. No. 3,890,763, issued June 24, 1975 and my copending U.S. patent application Ser. No. 683,611. In these machines, open top paperboard trays are loaded with the articles to be packaged and moved along a prescribed path. As the trays are conveyed along the path, a sheet of heat shrinkable film is dispensed over the articles in the tray and wrapped tautly down over the articles into juxtaposition with opposite sides of the tray by a plurality of flight bars moving along an endless path.

In one version of such machine, an appropriate adhesive such as a hot melt glue is applied to the side walls of the tray prior to the placement of the film thereover. The flight bars in the glue version press the film against the opposite sides of the tray to which the adhesive has been applied with sufficient pressure to cause the adhesive to bond the film to the tray.

In another version of the machine, the material of the film itself, rather than a separate adhesive, is used to bond the film to the tray. To do this, the film must be able to form a fiber tearing bond with a cellulosic tray under sufficient heat, time and pressure. The flight bars in the heat weld version press the film against the opposite sides of the tray while heating the film. The film is thusly held for a sufficient length of time for the film to weld itself to the tray side walls with the fiber tearing weld.

In both versions of the machine, the film is severed between trays to separate the film covered trays from each other. The resulting film sheet covering the articles and bonded to opposite side walls of the tray keeps the articles in the tray. Typically, the film used is heat shrinkable. This allows the thusly formed package to be passed through a heat tunnel so as to shrink the film and tightly lock the articles in the tray.

While both versions of the machine produce a package which has certain advantages, such as the film not being on the bottom of the trays, the resulting package has some drawbacks in that it is necessary to leave an unattached portion of the film below the point where the film is bonded to the side walls of the tray. This portion of the film, typically called the skirt, is loose so that it can become entangled in handling equipment in subsequent package handling operations. Further, the skirt also tends to become wrinkled during the heat shrinking operation and obscure any printing on the sidewalls of the tray.

SUMMARY OF THE INVENTION

These and other problems and disadvantages of the prior art are overcome by the invention disclosed herein by providing a multi-unit package including a group of articles mounted in a paperboard tray and over which is applied a film which is bonded to opposite sides of the tray in such a manner that no unattached skirt portion is left on the tray side walls. The multi-unit package may be initially formed on one of the prior art machines described hereinbefore to initially bond the film to the opposite side walls of the tray in a first position while leaving an unattached skirt portion thereon due to the flight bar thickness. Subsequently, this skirt portion is bonded to the tray side walls to produce a clean package and enhance the effective transparency of the skirt portion of the film so as not to obscure any printing or other information under the film on the tray side walls. This subsequent skirt bonding operation is carried out without detrimentally affecting the initial bonding of the film to the tray side walls. In fact, this secondary bonding increases the area over which the film is bonded to the tray walls and by so doing increases the strength of the bonds.

The package of the invention thus includes a paperboard tray with a bottom wall, unstanding side walls and upstanding end walls defining an open top article receiving recess filled with a group of articles such as cans, bottles, jars or the like. A plastic film sheet extends over the articles and is bonded to opposite side walls of the tray with an initial primary bond which produced a temporary unattached skirt portion below each of the primary bonds but which were subsequently heat bonded to the tray side walls to cause the skirt portions to lie in juxtaposition with the side wall outside surface to enhance the effective transparency of the skirt portions. The primary bonds may be made adhesively or by heat welding. While the primary bonds are made before the heat shrinking of the film sheet, the skirt portion may be bonded either before or after heat shrinking of the film sheet but typically this secondary bonding is done after the package leaves the heat tunnel. Also, the end portions of the film sheet which overlap the end walls of the tray may be heat bonded to the tray end walls for a neater package. Typically, the end portions of the film sheet are bonded to the end walls after heat shrinking of the film.

The method of the invention is for forming a multi-unit package. It includes generally moving an open top cellulosic tray with a pair of upstanding side walls along opposite sides thereof along a prescribed path with the tray loaded with a group of articles; placing a plastic film over the articles in the tray; while maintaining the film over the articles in the tray, primarily bonding the film to the outside of the tray side walls while leaving unattached skirt portions between the primary bond and the edges of the film sheet; and subsequently heat bonding the skirt portions of the film sheet to the outside of the tray side walls to cause the skirt portion to be held in juxtaposition with the outside of the tray side walls to enhance the effective transparency of the skirt portion. The method also includes heat shrinking the film sheet to lock the packages in place. The heat shrinking process typically is performed between the primary bonding and the skirt bonding. The primary bond is typically performed by heating and pressing the film to the tray side walls to heat weld the film thereto. Also, the end portions of the film sheet are heat bonded to the tray end walls immediately after heat shrinking.

These and other features and advantages of the invention disclosed herein will become more apparent upon consideration of the following detailed description and accompanying drawings wherein like characters of reference designate corresponding parts throughout the several views and in which:

These figures and the following detailed description disclose specific embodiments of the invention; however, it is to be understood that the inventive concept is not limited thereto since it may be incorporated in other forms.

DETAILED DESCRIPTION OF ILLUSTRATIVE EMBODIMENTS

Figure 1:
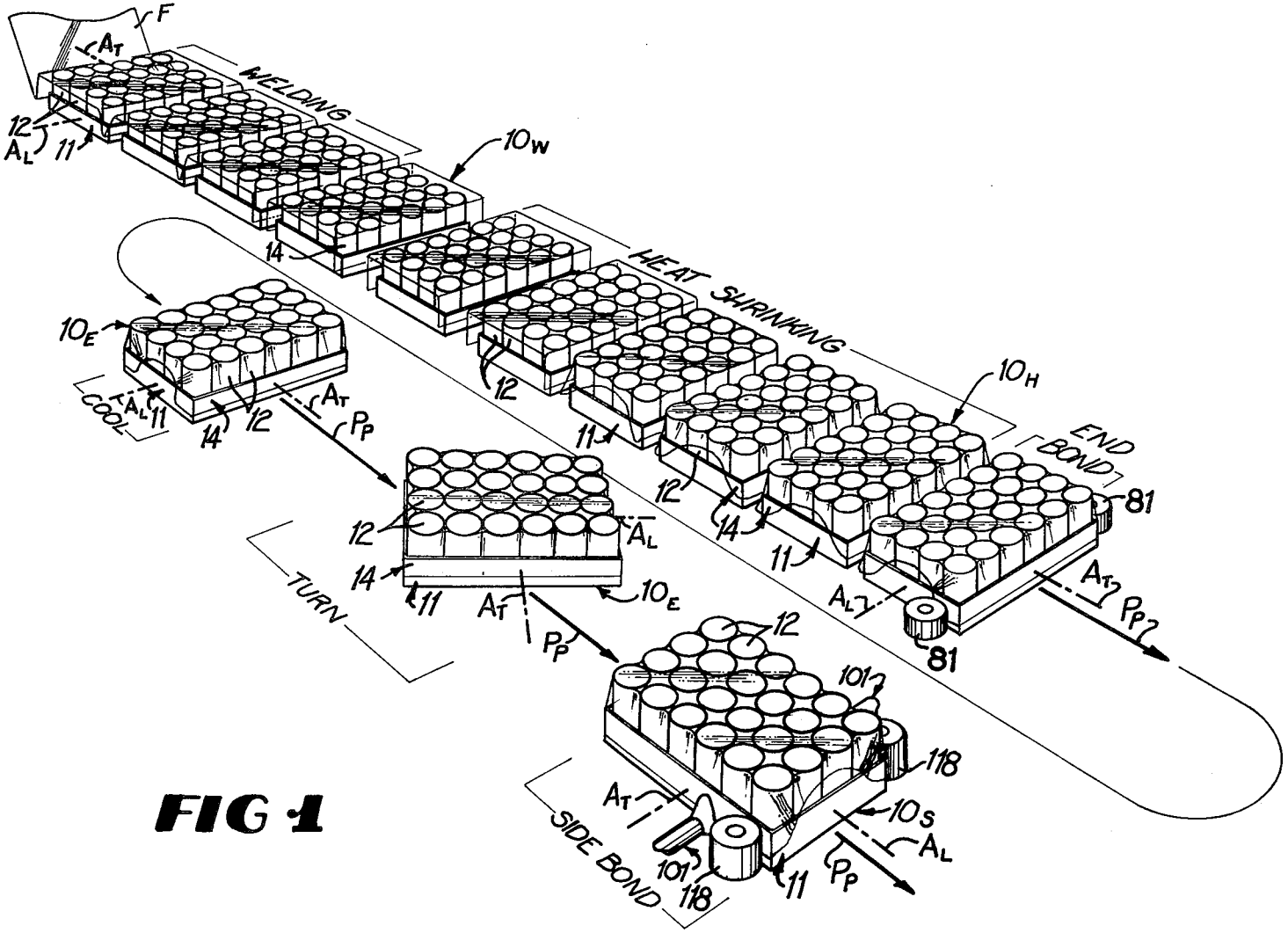
FIG. 1 is a perspective view illustrating the formation of the package of the invention.

Referring to FIG. 1, it will be seen that the multi-unit package 10 is formed from a cellulosic tray 11, a plurality of articles 12, and a film sheet 14 which extends over the articles 12 in the tray and is bonded to the tray side walls. The basic process of forming the package 10 is illustrated in FIG. 1. In a welding step, a continuous sheet of film is laid over the articles in the trays and bonded to the side walls of the tray with a primary bond. The film is then cut between trays to separate the trays with the film sheet 14 overlying the articles 12 in the tray 11 to form an intermediate welded package indicated at $\mathbf{10}_W$ where the film sheet has unattached skirt portions along opposite sides of the tray. The welded package $\mathbf{10}_W$ is then moved through a heat shrinking step which causes the film sheet 14 to heat shrink while the primary bonds hold the film sheet in place over the articles 12. The shrunk film sheet 14 holds the articles in place as it is heat shrunk to form the heat shrunk package indicated at $\mathbf{10}_H$ in FIG. 1. Immediately after the film sheet 14 is heat shrunk, the package is passed between a pair of non-stick rollers which roll down the shrunk film sheet along the end walls at opposite ends of the tray 11 to form the end bonded package identified as $\mathbf{10}_E$. The package $\mathbf{10}_E$ may sometimes be transferred through a cooling step so that the film sheet 14 is allowed to cool to apply tension in the film and firmly lock the articles in place. The package is then turned in a turning step so that the package is moving along its longitudinal axis through a skirt bonding step where the skirt portions of the film sheet along the side walls of the tray 11 are heated and then rolled against the side walls of the tray to form a smooth skirt bond therewith.

The cellulosic tray 11 may be paperbroard, chip board, cardboard, or the like. Typically, the tray 11 is made of uncoated corrugated paperboard. The plastic film for the sheets 14 is usually heat shrinkable so that it can be shrunk after application to the tray to lock the articles in place. If the film sheet 14 is primarily bonded to the tray 12 with an adhesive, it is only necessary that the film of the skirt be capable of simply adhering to the tray side walls when heated and pressed thereagainst. This is because the skirt bond need not be capable of carrying a load. On the other hand, if the film sheets are to be primarily bonded to the tray 12 using a heat weld, the film must be pressure and heat weldable or bondable to the cellulosic tray to form a bond commonly known in the industry as a "fiber-tear" bond. The fiber-tear bond is one in which the film adheres to the cellulosic tray sufficiently to prevent the bond from being broken without tearing cellulosic fibers from the tray.

While a wide variety of films are heat shrinkable, not all heat shrinkable film can be welded to the cellulosic trays 11. When monolayer film is used, it must be surface treated, such as by corona discharge or flame treatment in order to make it feasibly weldable. These treatments correspond generally to the surface treatments used for ink adhesion on such films. Multi-layer films may or may not need to be surface treated in order to weld to the cellulosic trays. Some examples of film which can be used are polyethylene, polypropylene, and polyvinyl chloride.

Figure 2:
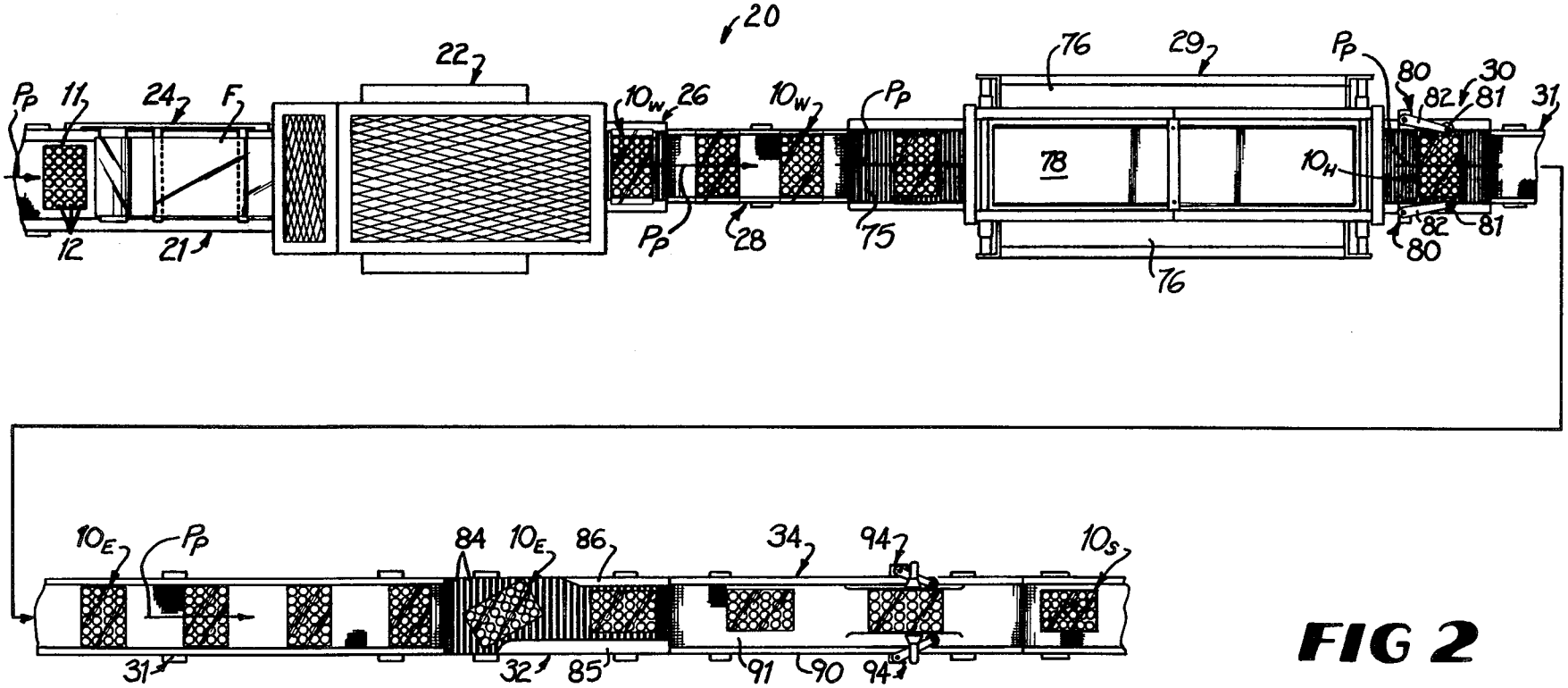
FIG. 2 is a schematic top plan view illustrating the machinery for forming the package of the invention.
Figure 3:
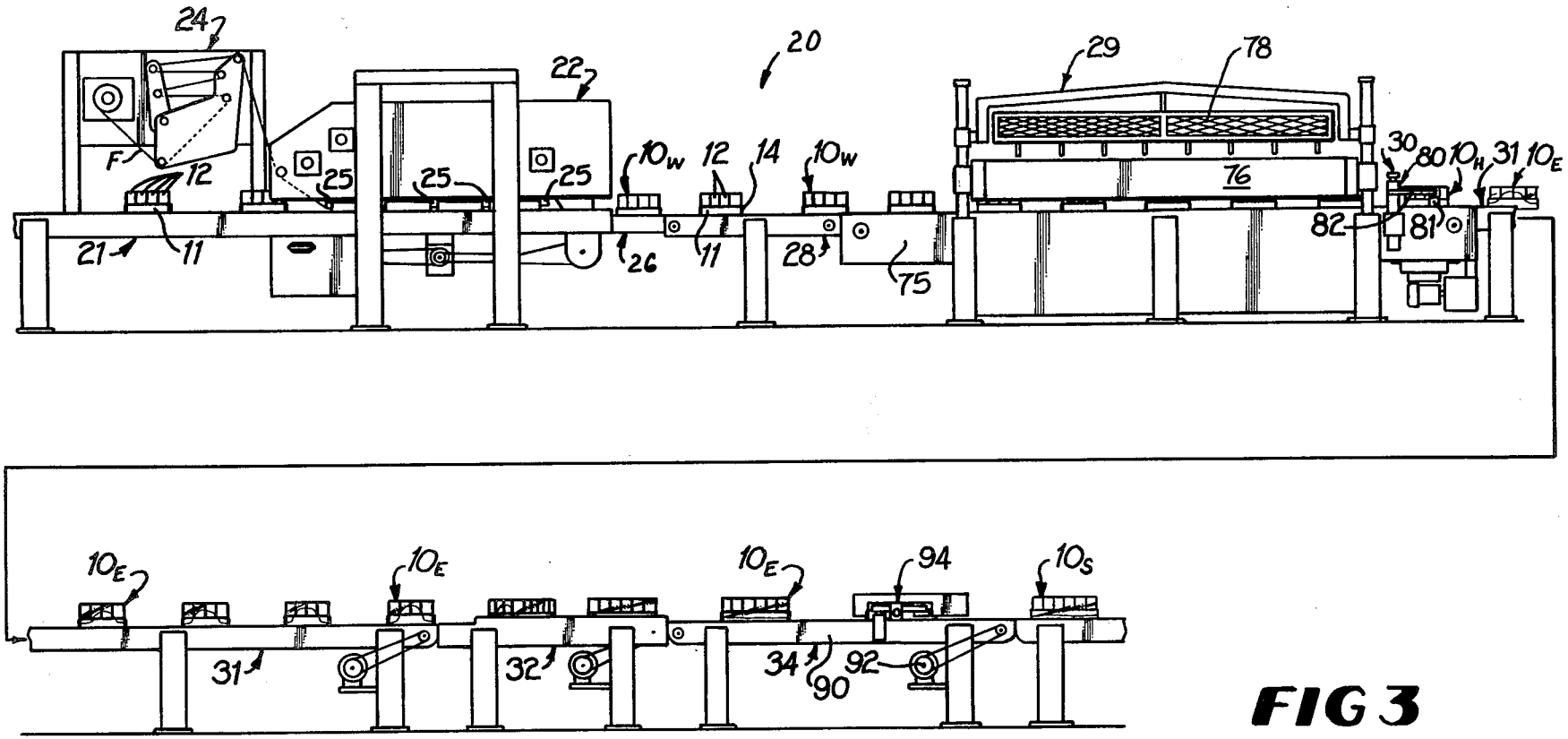
FIG. 3 is a schematic side elevational view illustrating the machinery for forming the package of the invention.

Referring to FIGS. 2 and 3, a typical packaging system 20 is illustrated for carrying out the formation of the multi-unit package 10. The specific mechanical arrangement of most of system 20 is illustrated in my earlier U.S. Pat. No. 3,890,763, issued June 24, 1975 and my co-pending U.S. patent application Ser. No. 683,611, filed May, 5, 1976. It will be appreciated that the machine disclosed in U.S. Pat. No. 3,890,763 is equipped to adhesively bond the film to the trays rather than by heat welding. As will become more apparent, the machine illustrated in my earlier U.S. Pat. No. 3,890,763 can be modified for heat welding by applying appropriate electrical heaters to the flight bars thereof.

The packaging system 20 illustrated in FIGS. 2 and 3 shows the non-adjustable heat welding version of that type of machine seen in my earlier U.S. Pat. No. 3,890,763. It is to be understood that the particular system shown is for purposes of illustration and not meant to be limiting.

Basically, the packaging system 20 includes an infeed section 21 which feeds the cellulosic trays 11 loaded with articles 12 to a compression and welding section 22. As the loaded tray 11 enters the compression and welding section 22, the continuous film F dispensed from a constant tension unwinder 24 is applied over the tops of the articles in the tray. The compression and welding section 22 is provided with a plurality of flight bars 25 moving along an endless path which draws the film over the articles in the tray and presses the film down against opposite side walls of the tray as will become more apparent. While the film is pressed against the side walls of the tray, it is heated sufficiently to cause it to heat bond or weld to the side walls of the tray. The flight bars 25 are equipped with cutters CM (FIG. 10) that sever the film between the trays after it is welded thereto so that a separate film sheet 14 covers each tray to form the separated welded package $\mathbf{10}_W$.

Figure 4:
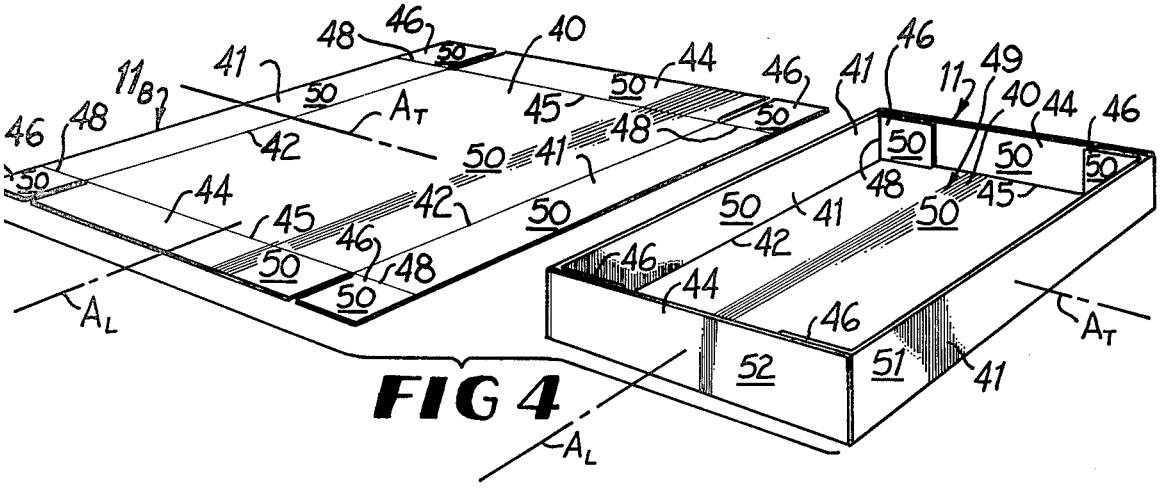
FIG. 4 is a set of perspective views illustrating the formation of the tray used in the package of the invention.

The thusly welded packages are discharged from the compression and welding section 22 onto an outfeed section 26 which moves the packages $\mathbf{10}_W$ out of the section 22. A transfer section 28 then moves the package $\mathbf{10}_W$ to the shrink section 29 which heat shrinks the film sheet 14 over the articles 12 in the tray 11 to form the heat shrunk package $\mathbf{10}_H$. As the package exits the shrink section 29, it passes through an end bonding section 30 which bonds the film sheet 14 to opposite ends of the tray to form the end bonded package $\mathbf{10}_E$. The thusly formed package $\mathbf{10}_E$ is usually then moved through a cooling section 31 where the shrunk film sheet 14 is allowed to cool to desirably tension the film sheet and tightly lock the articles 12 in tray 11. The cooled package $\mathbf{10}_E$ moves out of the cooling section 31 into a turning section 32 which turns the package from the position so that its transverse axis is oriented along the path of movement to a position so that its longitudinal axis is oriented along the path of movement. The thusly reoriented package $\mathbf{10}_E$ moves into a skirt bonding section 34 which serves to bond the skirt portions of the film sheet 14 below but adjacent to the primary heat weld to the side walls of the tray as will become more apparent to form the side bonded package $\mathbf{10}_S$ The cellulosic tray 11 is best illustrated in FIG. 4 which shows a tray blank $\mathbf{11}_B$ as well as the set up tray 11. The tray 11 includes a bottom wall 40 having a generally rectilinear shape with a pair of opposed upstanding side walls 41 integrally joined to the bottom wall 40 at fold lines 42 best illustrated on the blank 11B. A pair of opposed end walls 44 are also integrally joined to opposite ends of the bottom wall 40 along end fold lines 45. Opposite ends of each of the side walls 41 have integrally formed thereon attachment tabs 46 which are joined to the side walls 41 along tab fold lines 48. When the side walls 41 are folded upwardly perpendicular to the bottom wall 40 along fold lines 42 and the attachment tabs 46 folded inwardly along the tab fold lines 48 oriented perpendicular to the side fold lines 42, the end walls 45 can be adhesively attached to the tabs 46 as is well known in the container art. It will be noted that the attachment tabs 46 may likewise be foldably joined to the end walls 44 and glued to the side walls 41 to make the tray. Thus, it will be seen that the setup tray 11 defines an open top article carrying space 49 therein bounded by the interior surfaces 50 of the side walls 41, end walls 44, attachment tabs 46, and bottom wall 40. It will thus be seen that the exterior surfaces 51 on the side walls 41 and exterior surfaces 52 on the end walls 44 are left free for attachment to the film sheet 14 as will be further explained.

The tray 11 is loaded with a group of the articles 12 such as cans, bottles, jars or the like in known manner prior to reaching the compression and welding section 22. It will be appreciated that the number of articles 12 in each group may vary as is desired. The group of 6×4 articles illustrated is for illustration purposes only and not intended to be limiting.

As best seen in FIGS. 1–3, the loaded trays 11 are moved along the processing path $P_P$ by the infeed section 21 so that the transverse axis $A_T$ of the tray 11 is aligned with the path $P_P$. The infeed section 21 moves the thusly oriented tray into the compression welding section 22.

Figure 9:
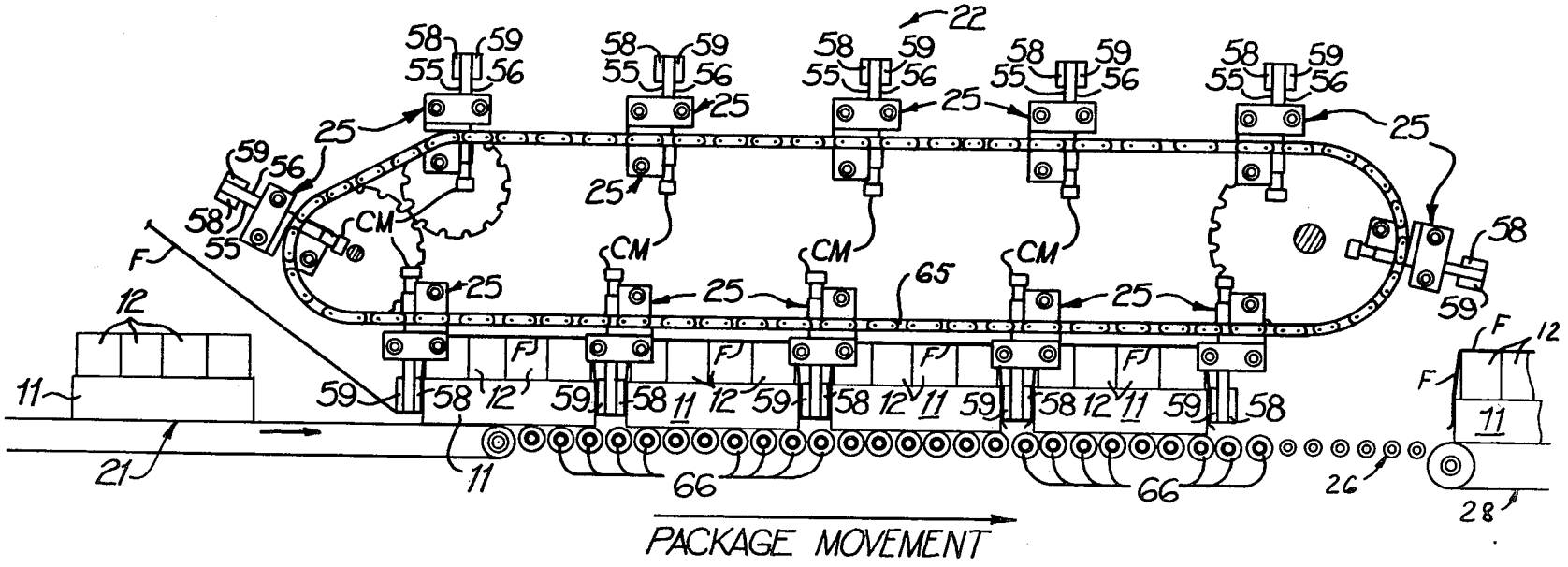
FIG. 9 is a schematic longitudinal cross-sectional view of the compression and welding section.

There are two general mechanical versions of these sections 22, a non-adjustable version designed to handle one size of trays shown in my prior U.S. Pat. No. 3,890,763, and an adjustable version designed to accommodate different sizes of trays illustrated in my co-pending U.S. patent application Ser. No. 683,611. It will further be understood that each of these mechanical versions may be equipped to primarily bond the film to the tray side walls either adhesively or through heat welding. When adhesive is applied to the side walls of the tray, the trays are typically moved lengthwise so that each side wall is exposed to its own glue applicator and receives a long longetudinal glue stripe where the film is to be bonded. A mechanical turner is supplied to turn the trays from traveling lengthwise to crosswise prior to film application as seen in FIG. 1–3. FIG. 9 schematically illustrates the non-adjustable version of the compression and welding section 22 equipped to heat weld the film to the tray side walls.

The flight bars 25 that move the trays through section 22 are oriented normal to the path of movement of the trays through the compression and welding section (i.e. normal to path $P_P$) so that each flight bar has a leading side 55 and a trailing side 56. The leading side 55 mounts a leading heating unit 58 thereon adapted to engage the film F and press it against the trailing side wall of the tray 11 leading the flight bar 25 as it is moved through section 22. The trailing side 56 of the flight bar 25 mounts a trailing heating unit 59 thereon adapted to engage the film F and press it against the leading side wall of the tray 11 trailing and flight bar 25. The leading and trailing heating units 58 and 59 have the same construction. Each heating unit 58 and 59 has an electrically operated resistive heating element 60 best seen in FIG. 10 which is resiliently mounted on a resilient pressure pad 61 on the flight bar 25 and covered with an oppropriate non-stick cover 62 to prevent the heating unit from sticking to the film when it is heated as is known in the art. The heating elements 60 heat the heating units 58 and 59 so that, as they press the film against the side walls 41 of the tray, the film will be heated to welding temperature to cause the film to bond or weld to the tray with a fiber tear bond.

The flight bar 25 is equipped with a film cutting mechanism CM (see FIG. 10) of known construction which can be selectively extended from the projecting end of the flight bar 25 between the heating units 58 and 59. This cutting mechanism serves to sever the film passing under the flight bar between adjacent trays in known manner so as to separate the film between adjacent trays after the film has been bonded or welded to the side walls of the trays.

Turning now specifically to FIG. 9, it will be seen that the compression and welding section 22 is designed to apply film to one size of trays with a primary heat weld. The flight bars 25 are mounted between a pair of endless chains 65 so that the flight bars 25 successively move along an endless path. The flight bars 25 are attached to the chains 65 so that they project outwardly therefrom at a fixed spacing along the chains. The chains are positioned so that, as the flight bars 25 move along the lower horizontal flights of chains 65, they are vertically oriented at fixed distances from each other. The chains 65 move in a counterclockwise direction as seen in FIG. 9 so that the flight bars 25 move from the infeed end of section 22 to the discharge end of the section (to the right in FIG. 9) as they move along the lower flights of chains 65 and return along the upper flights of the chains.

A plurality of free turning and/or driven support rollers 66 are provided below the lower flights of chains 65 to support the trays 11 on the tops thereof so that the heating units 58 and 59 on the flight bars 25 will engage the side walls 41 of the trays 11 as the flight bars 25 move along the lower flights of chains 65. The spacing between the flight bars 25 is such that, as they move along the lower flights of the chains 65, the trays 11 will be captivated between adjacent flight bars 25 and moved thereby over the rollers 66.

The film F extends under the lower projecting ends of the flight bars 25 moving along the lower flights of chains 65 and is maintained under tension by the unwinder 24 seen in FIGS. 2 and 3. Each loaded tray 11 is fed toward the trailing side of that flight bar 25 on the lower flights of chains 65 at the infeed end of section 22 on the powered infeed section 21. The spacing of the trays on the infeed section 21 is such that the incoming trays do not interfere with the movement of the flight bars 25 as they are moved by chains 65 as is known in the art. This action forces the leading side wall 41 of the incoming tray against the trailing heating unit 59 on the flight bar 25 so that the film F extends up between the heating unit 59 and the leading side wall 41 of the tray and over the articles 12 in the tray 11. The chains 65 are then advanced in known manner with the infeed section 21 maintaining the tray against the flight bar. As the next flight bar 25 moves onto the lower flights of chains 65, the projecting end thereof engages the top of the film F and pulls it over the top of the articles 12 in the tray 11. As this next flight bar 25 moves into the vertical position on the lower flight of the chains 65, the heating unit 58 on the leading side thereof forces the film against the trailing side wall 41 of the tray 11. The spacing between the flight bars 25 is such that the film is forced against the side walls 41 of the tray with the necessary pressure to cause the film to bond or weld to the side walls 41 of the tray 11 when the film F is heated to welding temperature. Thus, it will be seen that adjacent flight bars 25 form a pocket therebetween as they move along the lower flights of chains 65 in which the film wrapped tray is carried as the flight bars move toward the discharge end of the section 22. As the tray in the pocket is moved through the section 22, the heating units 58 and 59 heat the film in contact with the opposite side walls 41 of the tray to welding temperature to affect bonding or welding of the film to the tray side walls 41. Since the film is continuous, it remains connected to the trays in the adjacent pockets. To separate the film between the trays, the cutting mechanism in the flight bar is activated after the film is welded to the tray to separate the trays. When the flight bar 25 leading the tray reaches the discharge end of section 22, it moves off the lower flights of chains 65 and up toward the upper return flights thereof. This frees the tray with the film welded thereto so that the tray is deposited on the outfeed section 26.

While bonding or welding of the film F to the tray side walls 41 is dependent on the welding characteristics of the particular film being used, the welding of each film is a function of temperature, contact pressure, and time to produce acceptable welds between the tray and film. In other words, each film must be pressed against the tray at a prescribed pressure while the film is heated to a temperature within the welding temperature range of the film and maintained at such temperature for a sufficient period of time for the film to bond or weld to the tray side wall. These required welding parameters vary from film to film and are typically empirically established for each type of film. While not meant to be limiting, an example of some typical parameters for monolayer films of low density polyethylene with a thickness of about 0.002 inch are a temperature of about 250°-300° F. under a compression of about 5-10 psi maintained for about 3-4 seconds. The amount of compression in the section 22 is controlled by the spacing between the flight bars 25 and is selected so that the film F will be pressed against the tray 11 in each pocket with the desired contact pressure. The heating units 58 and 59 are electrically powered continuously from an endless bus bar as they move around the endless path of movement on chains 65 so that they can be normally maintained at a prescribed temperature toward which the film is to be heated as will become more apparent. The timing during which the film is heated during normal operation is determined by the length of time it takes each pocket carrying a tray to move from the infeed end to the discharge end of the section 22. The compression and welding section is designed so that the flight bars 25 advance one position each time a loaded tray 11 is received. Thus, when trays 11 are fed to section 22 at its designed capacity, the minimum time it takes a pocket to advance from the infeed to discharge end of the section 22 is encountered. The number of pockets selected to be maintained under compression at the same time is such that each pocket is maintained under compression for a period of time just exceeding that required to affect welding of the film F to the tray side walls 41 when the section 22 is operating at designed capacity.

Many of the films which can be bonded or welded to the tray such as low density polyethylene exhibit an undesirable characteristic of melting or burning through at the welds if held at welding temperature for too long a period of time. This is especially true for monolayer film. This burn through time is, of course, longer than the time required to affect welding of the film to the tray side walls. To prevent burn through in the film when the machine is operating at its designed capacity, the number of pockets selected to be maintained under compression at the same time is such that each pocket is not maintained under compression for a period of time exceeding the burn through time of the film being used. If the flow of trays to section 22 is interrupted, however, the time that the pockets remain in compression may be extended beyond the burn through time for the film. To prevent film burn through, an appropriate control circuit is provided which causes the temperature of the heating units 58 and 59 associated with each pocket to be reduced to a holding temperature low enough to prevent film burn through if the pocket remains in compression for a period of time exceeding the burn through time. It will be appreciated that the temperature of the heating units 58 and 59 at each pocket will not need to be reduced while the section 22 is operating at its normal speeds.

Figure 5:
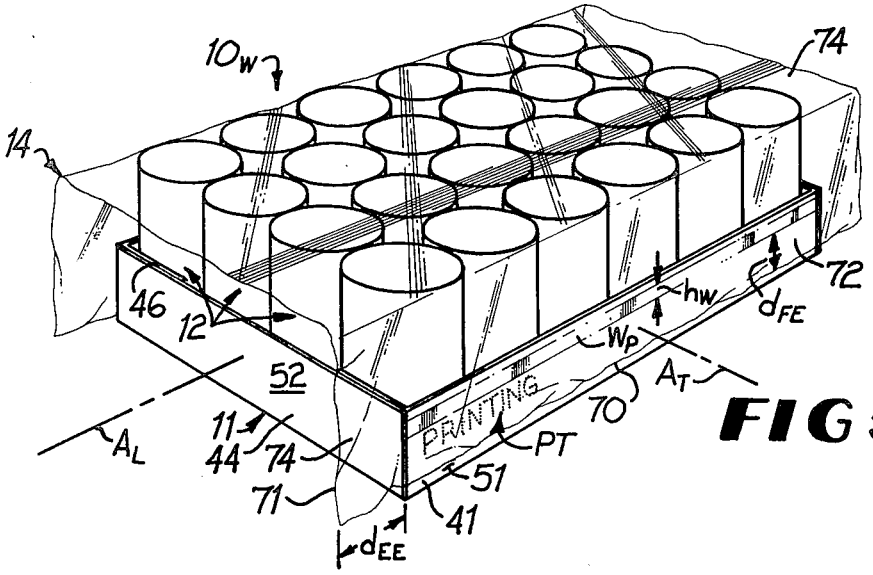
FIG. 5 is a perspective view illustrating the package of the invention after the film has been welded to the tray.
Figure 10:
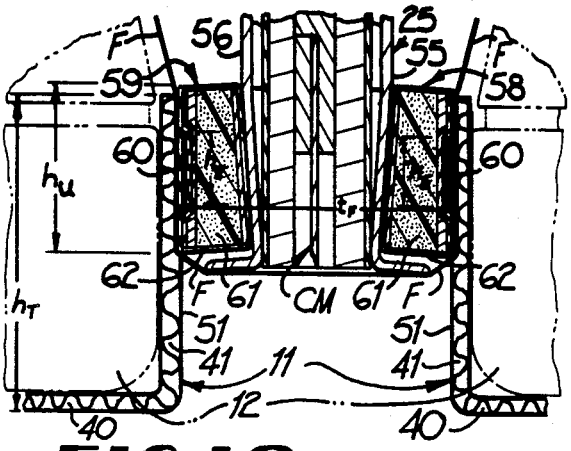
FIG. 10 is an enlarged partial cross-sectional view showing the heating units forming the primary weld.

As seen in FIG. 10, the heating element 60 in each heating unit 58 and 59 has a prescribed height $h_E$ less than the height $h_U$ of the heating unit. The height $h_T$ of the side walls 41 and end walls 44 is greater than the height of heating units 58 and 59. The height $h_W$ of the primary heat weld $W_P$ seen best in FIG. 5 which is formed by the heating units 58 or 59 corresponds generally to the height $h_E$. One typical height $h_E$ for the heating elements 60 is about one-half inch producing a weld height $h_W$ of about 7/16–9/16 inch. The heating unit height $h_U$ is usually in the order of one inch. The tray height $h_T$ is typically 2–7 inches high depending on the article size with the height $h_T$ illustrated at about two inches. This arrangement allows the weld $W_P$ to be made adjacent the upper projecting edges of the side walls 41 such that the distance from the upper edge of $W_P$ to the top edges of the side walls will vary between $\frac{1}{4}''$ to $\frac{1}{2}''$. The resilient pressure pads 61 are sufficiently thick to permit the heating element 60 to conform to the side walls 41 even though the side walls 41 flex due to the exterior shape of the articles 12 in the tray 11 as the heating units 58 and 59 press against the side walls 41 so that welding pressure is maintained along the full length of the side walls 41. The primary weld $W_P$ forms a fiber tearing bond with the tray side walls 41.

It will be seen from FIG. 10 that the lower projecting end of each flight bar 25 has an effective thickness $t_F$ which is substantially the distance between the covers 62 on the two heating units 58 and 59 on opposite sides of the flight bar 25. Since the film F extends under the flight bar 25 as the film is welded to the side walls 41 of the tray 11, it will be seen that a prescribed portion of film will be below the weld $W_P$. When this film is cut, one-half of the excess film goes with each tray 11 to which the film has been welded to form a non-welded skirt portion 72 seen in FIG. 5 on the heat welded package $10_W$. Thus, it will be seen that the film sheet 14 projects below the weld $W_P$ a distance $d_{FE}$ to the free side edge 70 of the film sheet 14. The end edges 71 on the end portions 74 of the film sheet 14 project outwardly beyond opposite ends of the group of articles 12 in the tray 11 for the distance $d_{EE}$. As will become more apparent, the distance $d_{EE}$ is selected such that the film sheet 14 will not shrink excessively and pull up over the ends of the group of articles 12 during the heat shrinking operation. The distance $d_{FE}$, on the other hand, is controlled by the thickness $t_F$ of the flight bar 25 with the distance $d_{FE}$ usually in the order of 1–1.5 inches.

The heat welded and separated packages $10_W$ roll across the outfeed section 26 onto the transfer section 28. The transfer section 28 continues to move the welded package $10_W$ along the processing path $P_P$ with the transverse axis $A_T$ thereof coinciding with the path $P_P$. The transfer section 28 moves the package $10_W$ onto the conveyor 75 in the heat shrink section 29 as seen in FIGS. 2 and 3.

The conveyor 75 continues to move the package $10_W$ along its transverse axis $A_T$ through the heat shrink section 29. The heat shrink section 29 includes end heaters 76 to heat opposite ends of the package $10_W$ and a group of top heaters 78 which heat the top of the package $10_W$ as it moves thereby on conveyor 75. It will thus be seen that the heaters 76 and 78 serve to heat the film to the desired temperature for heat shrinking it into place around the articles 12. The operation of the heat shrink section 29 is well known in the art and may be either of the infra-red type or hot air type.

Figure 6:
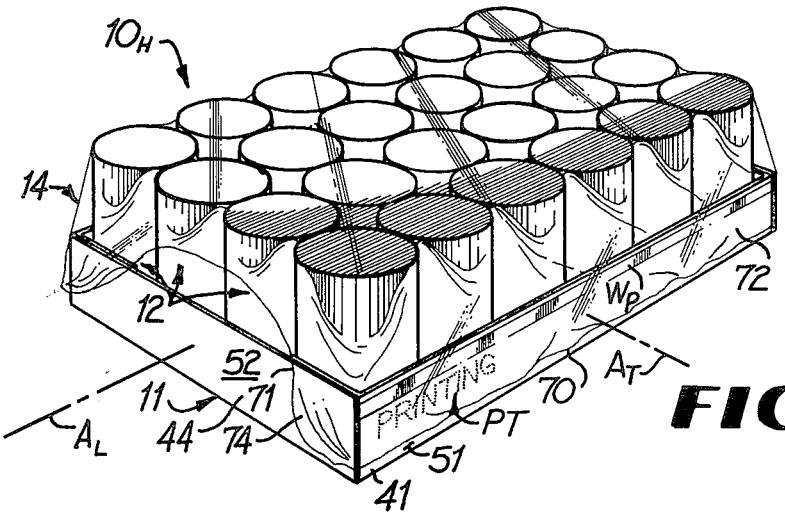
FIG. 6 is a perspective view illustrating the package of the invention after the film has been heat shrunk.

FIG. 6 illustrates the welded and shrunk package $10_H$ after it has been heat shrunk in the shrink section 29. It will be seen that the end portions 74 of the film sheet 14 which projected past the ends of the side walls 41 on the tray 11 have now been pulled down over the tops of opposite ends of the group of articles 12 to hold the group of articles together in the direction on of the longitudinal axis $A_L$ of the package $10_H$. This also pulls the end portions 74 loosely around the corners of the tray 11 over the end walls 44 but are not attached thereto. The primary heat welds $W_P$ hold the film sheet 14 to the side walls 41 of the tray 11 as the film sheet 14 is being shrunk down over the tops of the articles 12. This serves to hold the group of articles 12 together as a unit in the direction of the transverse axis $A_T$ of the package $10_H$. The welds $W_P$ also serve to interlock the group of articles 12 and the tray 11 together as a unitary package. It will further be noted that the non-welded skirt portions 72 along the side edges of the film sheet 14 projecting below the welds $W_T$ remain unattached to the tray side walls.

The welded and shrunk package $10_H$ as seen in FIG. 6, then, has the desired package integrity with the primary welds $W_P$ holding it together. At this stage, however, the skirt portions 72 and end portions 74 remain unattached to the tray 11. This is undesirable both from a cosmetic standpoint and a handling standpoint. Any wrinkling in the skirt and end portions 72 and 74 caused by the welding and heat shrinking processes serves to obscure any printing PT on the side and end walls 41 and 44 lying under these portions. These portions 72 and 74 can also catch in package handling equipment to damage the film sheet 14 and/or package integrity.

Figure 11:
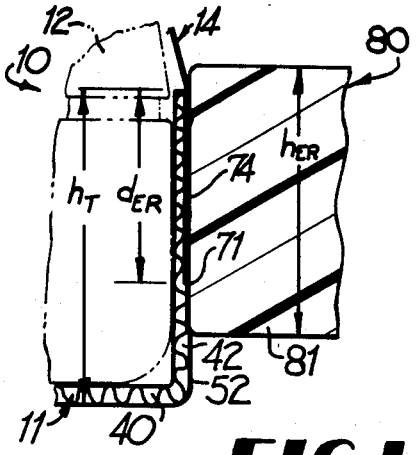
FIG. 11 is an enlarged partial cross-sectional view showing the end bond being made.

As the package $10_H$ passes out of the shrink section 29 on the conveyor 75, it is passed through the end bonding section 30. As best seen in FIGS. 2 and 3, the end bonding section 30 is mounted on the conveyor 75 and includes a pair of roller assemblies 80 mounted on opposite sides of the conveyor 75. Each roller assembly 80 includes a non-stick roller 81 rotatably mounted in a pivot arm 82 about a vertical axis. The pivot arm 82 is also pivotally mounted about a vertical axis and is spring urged so as to force the nonstick roller 81 against the end of the tray. Thus, the rollers 81 are forced inwardly so that the tray 11 is captivated therebetween with the rollers 81 rolling along opposite end walls 44 on the tray 11. As seen in FIG. 11, this causes the rollers 81 to roll over the end portions 74 of the film sheet 14 overlying the end walls 44 of the tray 11. The roller assemblies 80 are located close enough to the heaters 76 and 78 for the end portions 74 of the film sheet 14 to still be sufficiently hot from passage through the shrink section 29 to cause the end portions 74 to bond to the end walls 44 under the pressure of the rollers 81. This serves to tack the end portions 74 to themselves and to the end walls 44 to prevent these end protions 74 from becoming entangled in handling equipment and to improve the appearance of the end bonded package $10_E$. It will be appreciated that the adherence between the end portions 74 of the film sheet 14 and end walls 44 on tray 11 do not necessarily have to be fiber-tearing bonds since they do not have to carry the primary load of the welds $W_P$ to maintain package integrity. However, where these bonds do have a fiber-tear quality, the overall package integrity is enhanced. Typically, the end portions 74 of the film sheet 14 have been heated up to a temperature of about 250°-270° F. and is sufficient to permit bonds with some fiber-tear capability provided the proper pressure and time is used. The spring pressure on rollers 81, however, is somewhat limited since the package is totally driven by the conveyor 75 so that package movement is limited by the frictional forces between the conveyor 75 and the tray 11. Typically, the pressure of the rollers 81 against the film is about 5-10 psi. With a more positive drive between conveyor 75 and the tray, however, this pressure can be inceased.

Figure 7:
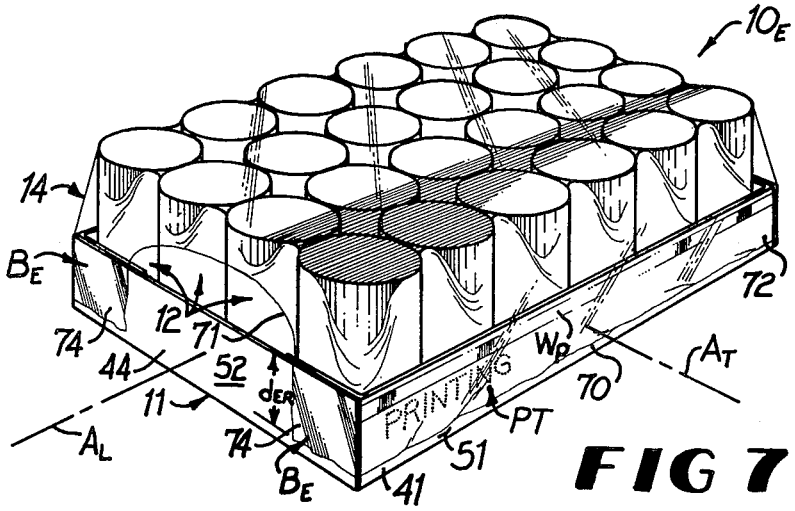
FIG. 7 is a perspective view illustrating the package of the invention after the end bond has been made.

As best seen in FIG. 11, the rollers 81 have a height $h_{ER}$ greater than the distance $d_{ER}$ the end portions 74 on film sheet 14 project down over the end walls 44 on tray 11. This insures that all of the end portions 74 in contact with the tray end walls 44 will be pressed flat to enhance the effective transparency of the portions 74 and thus reduce the obscuring of any printing thereunder. FIG. 7 illustrates the end bonded package $\mathbf{10}_E$ with the end bonds being indicated at $B_E$.

As seen in FIGS. 2 and 3, the end bonded package $\mathbf{10}_E$ is transferred off the conveyor 75 in the shrink section 29 onto the cooling section 31 which continues to move the package $\mathbf{10}_E$ along the processing path $P_P$ with the transverse axis $A_T$ of the package $\mathbf{10}_E$ aligned with the path $P_P$. The cooling section 31 permits the package $\mathbf{10}_E$ to be exposed to the ambient atmosphere to allow the film sheet 14 to cool to tension the heat shrunk film sheet 14 so as to tightly lock the articles 12 and tray 11 together and increase package integrity.

The packages $\mathbf{10}_E$ are discharged off the cooling section 31 onto the turning section 32 which serves to reorient the package $\mathbf{10}_E$ so that its longitudinal axis $A_L$ is aligned with the processing path $P_P$. The turning section 32 (See FIG. 3) includes a plurality of live rollers 84 which drive the package $\mathbf{10}_E$ along the processing path $P_P$. A turning abutment 85 is provided on one side of the processing path $P_P$ to engage one of the corners of the package $\mathbf{10}_E$ and hold back on this corner of the package while the live rollers 84 continue to drive the opposite end of the package. This, of course, causes the package to turn about its center so that the longitudinal axis $A_L$ becomes aligned with the processing path $P_P$. A deflector 86 is provided on the opposite side of the processing path $P_P$ to force the turned end of the package $\mathbf{10}_E$ inwardly to finish the alignment of the longitudinal axis $A_L$ with the path $P_P$. Thus, it will be seen that the package $\mathbf{10}_E$ is now turned so that the skirt portions 72 of the film sheet 14 along the side walls 41 of the package $\mathbf{10}_E$ are generally aligned with and laterally spaced from opposite sides of the processing path $P_P$. It is to be understood that the turning section 32 may have other specific constructions without departing from the scope of the invention.

The turned package $\mathbf{10}_E$ is discharged from the turning section 32 onto the skirt bonding section 34 as seen in FIGS. 2 and 3. The skirt bonding section 34 includes a support frame 90 whose longitudinal axis is in vertical registration with the processing path $P_P$. The frame 90 rotatably mounts an endless conveyor belt 91 thereon so that the conveyor belt 91 moves along the processing path $P_P$. The conveyor belt 91 is driven by an appropriate drive motor 92 so that the upper flight of the belt 91 moves from the left to the right as seen in FIGS. 2 and 3. The turned package $\mathbf{10}_E$ is discharged onto the upper flight of the conveyor belt 91 from the turning section 32 so that the conveyor belt 91 moves the package $\mathbf{10}_E$ along the processing path $P_P$ with the longitudinal axis $A_L$ aligned with path $P_P$.

Figure 14:
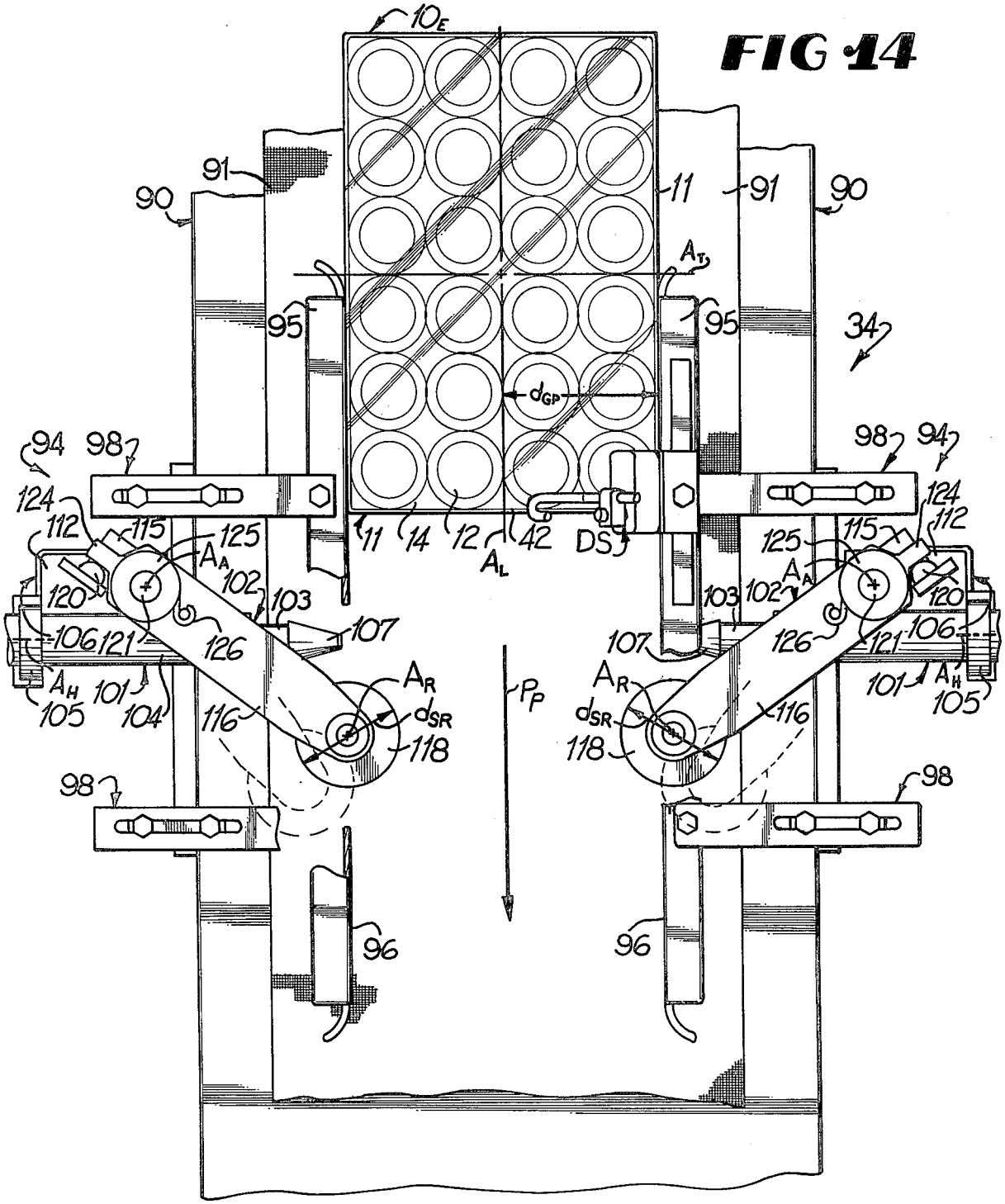
FIG. 14 is a top plan view thereof.
Figure 15:
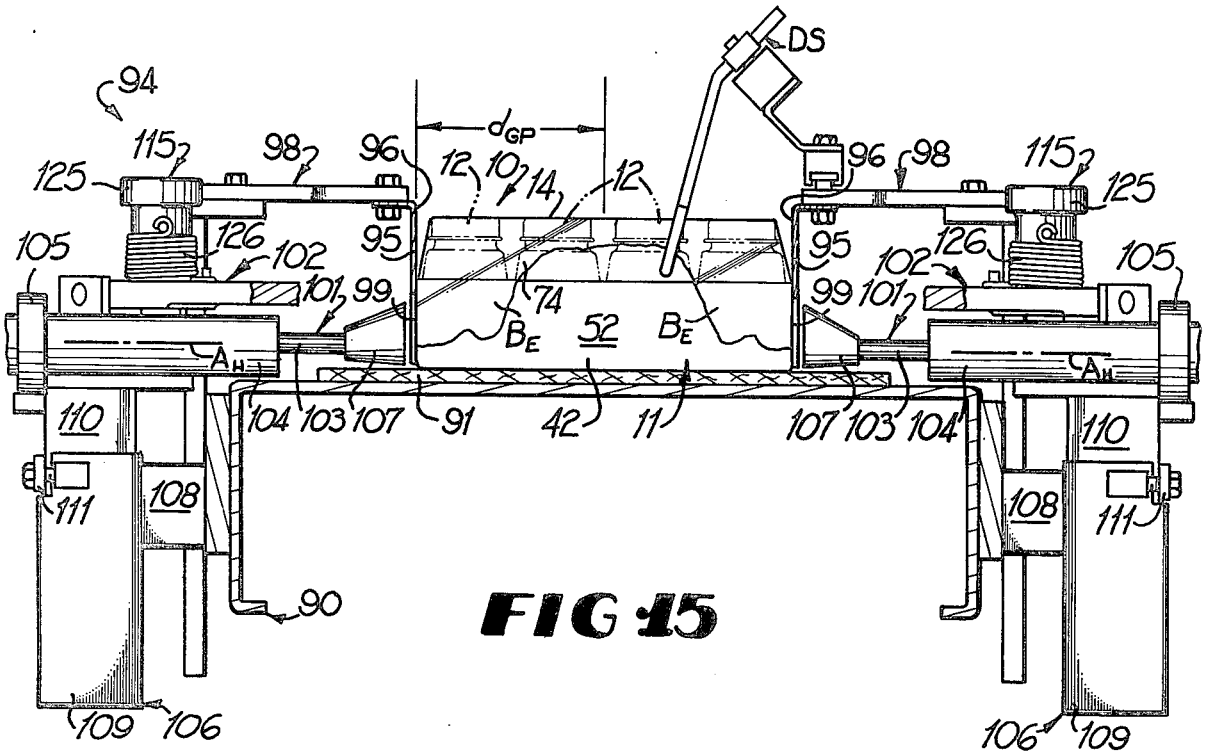
FIG. 15 is a cross-sectional view taken generally along line 15—15 in FIGS. 13 and 14.
Figure 16:
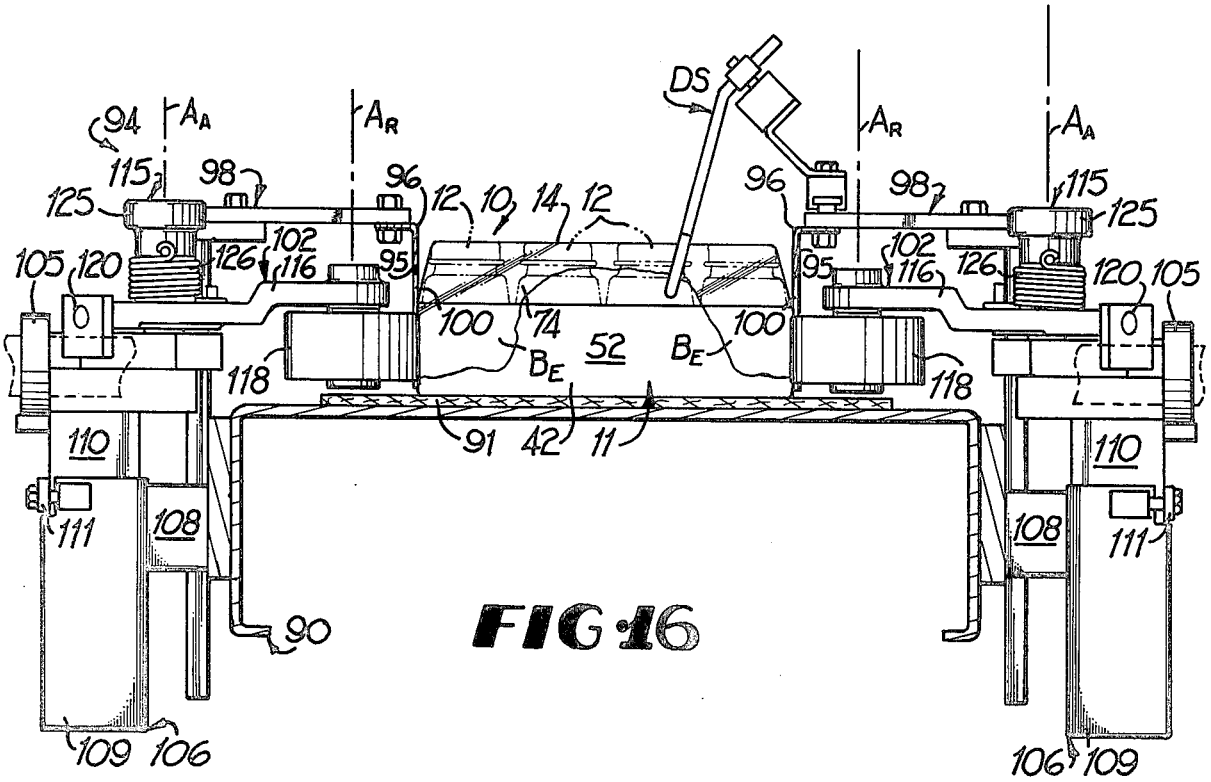
FIG. 16 is a cross-sectional view taken along line 16—16 in FIGS. 13 and 14.

The skirt bonding section 34 also includes a pair of bonding assemblies 94 mounted on the frame 90 on opposite sides of the conveyor belt 91 adjacent the downstream end of the section 34. The bonding assemblies 94 are best illustrated in FIGS. 13-16. Each of the bonding assemblies 94 includes an upstanding guide plate 95 whose inside surface 96 faces the processing path $P_P$. The guide plate 95 is oriented generally parallel to the processing path $P_P$ and is spaced outwardly therefrom a prescribed distance $d_{GP}$ from the processing path $P_P$ as best seen in FIG. 14. An appropriate adjustable mount 98 mounts the guide plate 95 on the frame 90. Thus, it will be seen from FIG. 14 that the package $\mathbf{10}_E$ will be captivated between the guide plates 95 as the conveyor belt 91 moves the packages $\mathbf{10}_E$ along the path $P_P$. This causes the unattached skirt portions 72 of the film sheet 14 depending below the weld $W_P$ to be loosely held against the side wall 41 of the tray 11. The guide plate 95 is provided with a first upstream heater cutout 99 which joins with a downstream roller cutout 100 that extends upwardly from the lower edge of the guide plate 95.

A heater assembly 101 is mounted on the frame 90 in registration with the heater cutout 99 so as to heat the side portions 72 of the film sheet 14 as it passes thereby and a roller assembly 102 is mounted on the frame 90 in registration with the roller cutout 100 to press the skirt portion 72 of the film sheet 14 down against the side wall 41 of the tray 11 to affect bonding thereof as will become more apparent.

While it is understood that the heater assembly 101 may be either of the infra-red type or the hot air type, the heater assembly 101 illustrated is of the hot air type and is commonly called an air torch. The heater assembly 101 illustrated includes an elongate cylindrical heater body 104 with a heater axis $A_H$. A hot air discharge tube 103 projects outwardly from the end of body 104 and is equipped with an air horn 107 which directs the hot air discharge approximately axially of axis $A_H$ but with a greater cross-sectional dimension in one direction than in the other. As will become more apparent, this allows the amount and location of heat to be applied toward the film sheet 14 to be varied. The heater body 104 houses a heater element 131 best seen in FIG. 17 for heating the air from a pressurized air source passing through body 101 to heat same. The heater body 104 is mounted in an adjustable bracket 105 carried on an adjustable mounting assembly 106.

The adjustable mounting assembly 106 includes a spacer tube 108 attached to the frame 90 and projecting laterally outwardly therefrom. On the projecting end of spacer tube 108 is mounted a vertically oriented support tube 109. A support post 110 is slidably received in the upper end of support tube 109 so that it is vertically oriented and can be adjustably projected above the top of the support tube 109. An appropriate lock mechanism 111 is provided for selectively locking the support post 110 at any vertically adjustable position with respect to the support tube 109.

The adjustable bracket 105 mounting the heater body 104 is mounted adjacent the top of the support post 110 so that the heater axis $A_H$ projects horizontally inwardly from the bracket 105 toward the cutout 99 in the guide plate 95. It will be appreciated that the heater body 104 is tubular so that it can be rotated about axis $A_H$ to orient the major axis of the air horn 107. The air horn 107 is also rotatable with respect to the hot air tube 103. The heater body 104 can also be moved back and forth along its length toward and away from the cutout 99 in the guide plate 95 to locate the discharge from the air horn 107 at the desired distance from the skirt portion 72.

Mounted on top of the support post 110 and projecting inwardly therefrom is a roller mounting bracket 112 which mounts the roller assembly 102. Thus, it will be seen that moving the support post 110 vertically up and down adjusts the vertical spacing of both the heater assembly 101 and roller assembly 102 with respect to the openings 99 and 100 and thus the side wall 41 of the tray 11 in the package $10_E$ as it passes thereby as will become more apparent.

The roller assembly 102 includes generally a mount 115 carried on the mounting bracket 112 and on which is pivotally mounted a pivot arm 116 for pivoting about a vertical axis $A_A$. The pivot arm 116 rotatably mounts a side roller 118 also about a vertical axis $A_R$. The mount 115 includes a base member 119 which mounts an arm stop 120 to limit the pivotal movement of the pivot arm 116 as will become more apparent. A vertically extending pivot shaft 121 is mounted on the base member 119 and projects upwardly therefrom. The pivot arm 116 is provided with an upstanding boss 122 thereon and defines a common passage through the boss and arm which is rotatably received around the pivot shaft 121 so that the pivot arm 116 is free to pivot about shaft 121 as limited by the stop 120. It will be appreciated that that portion of the pivot arm 116 projecting past the shaft 121 is provided with a stop projection 124 which engages the stop 120 to limit the inward pivoting movement of the arm 116.

The mount 115 also includes a spring mount 125 fixedly mounted to the upper end of the shaft 121 extending above boss 122 on the pivot arm 116. A torsion coil spring 126 is pinned to the spring mount 125 at one end and to the pivot arm 116 at its other end so that the pivot arm 116 is constantly urged toward the roller cutout 100 in the guide plate 95. It will be appreciated that the base member 119 in the mount 115 can be adjustably attached to the roller mounting bracket 112 on post 110 so that the inwardmost pivoted position of the pivot arm 116 can be adjusted as needed. The amount of spring tension to be maintained on the pivot arm 116 by the torsion coil spring 126 can be adjusted simply by rotating the spring mount 125 on the shaft 121 and relocking it back into position.

Figure 12:
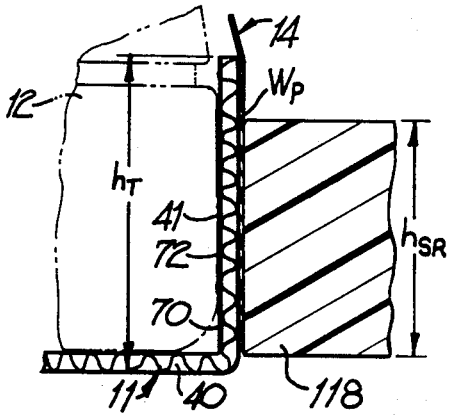
FIG. 12 is an enlarged partial cross-sectional view showing the skirt bond being made.
Figure 13:
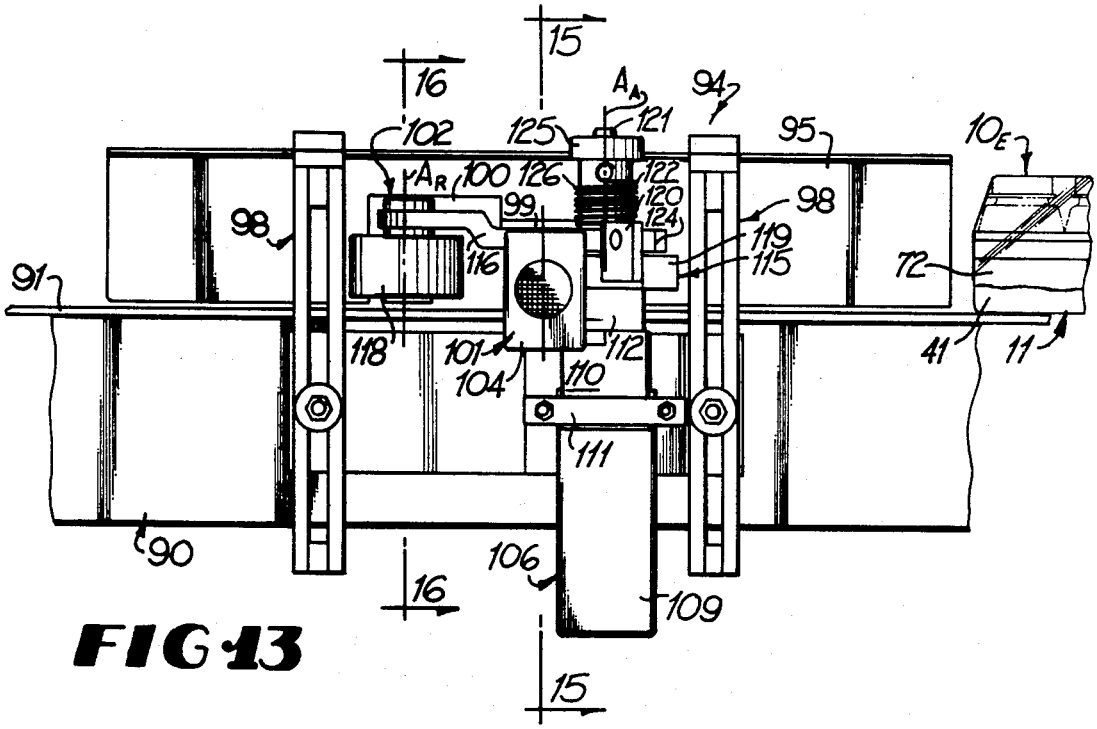
FIG. 13 is a side elevational view of the skirt sealer unit.

It will be seen in FIGS. 12 and 14 that the roller 118 has a prescribed height $h_{SR}$ and a diameter $d_{SR}$. The diameter $d_{SR}$ is selected to minimize the flexure of the side wall 41 with different sizes and shapes of articles 12 to be processed in the package. The height $h_{SR}$ of the roller 118 is typically selected to cover the skirt portion 72 of film sheet 14 while also overlapping a portion of the primary weld $W_P$. As the package $10_E$ passes between rollers 118, the skirt portions 72 will be compressed against side walls 41. It will also be appreciated that the rollers 118, like the rollers 81, are made of a nonstick material such as Teflon.

Figure 17:
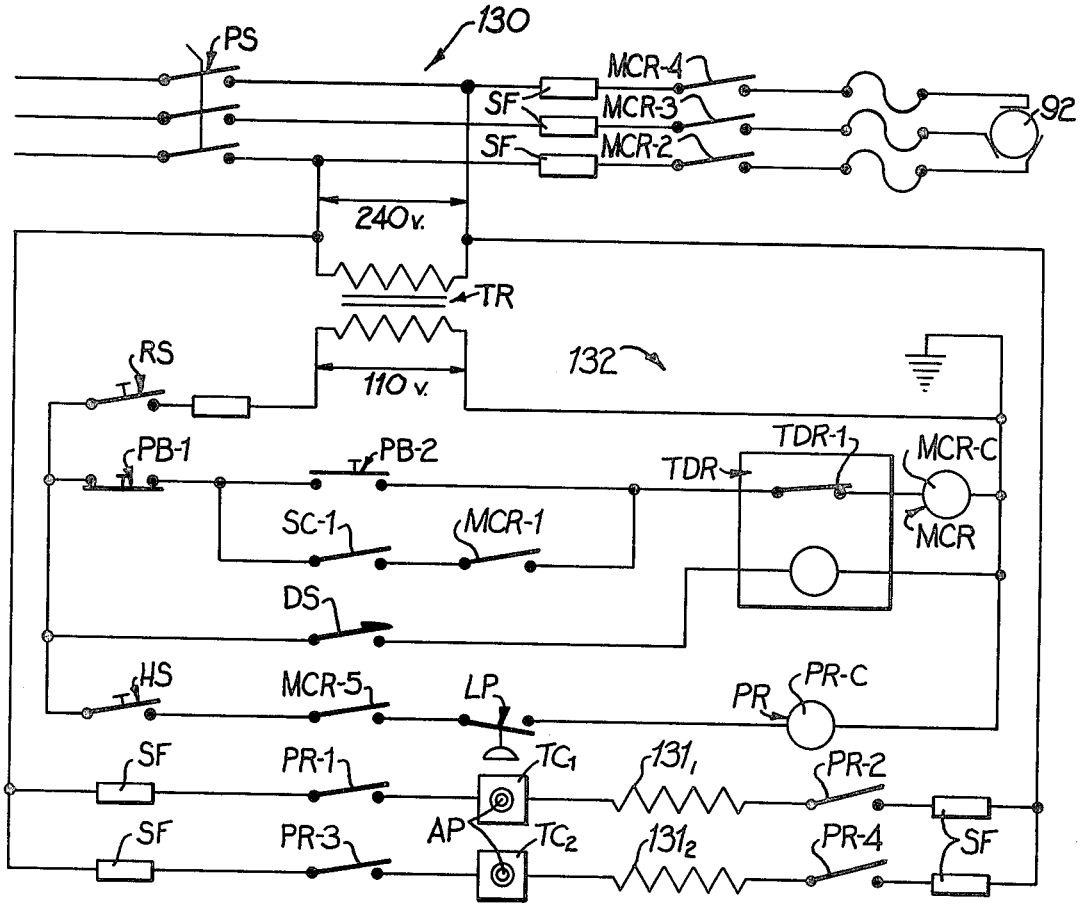
FIG. 17 is an electrical schematic for the skirt sealer unit.

The control circuit 130 for the skirt bonding section 34 is schematically illustrated in FIG. 17. The conveyor drive motor 92 is powered from a 240 volt power source through power switch PS, the normally open contacts MCR-2 through MCR-4 of a master control relay MCR and fuses SF.

A control subcircuit 132 is powered through a step-down transformer TR and energized through run switch RS. The subcircuit 132 powers the coil MCR-C of master control relay MCR through normally closed stop switch PB-1; normally open start switch PB-2, and normally closed contacts TDR-1 of time delay relay TDR. Normally open contacts MCR-1 in series with normally open contacts SC-1 form a holding circuit across switch PB-2. Contacts SC-1 are controlled by an appropriate relay (not shown) in the heat shrink section 29 and remain closed as long as the heat shrink section is operating.

The time delay relay TDR is controlled by detector switch DS which remains closed as long as there is a package $10_E$ present at the bonding assemblies 94. When switch DS is closed, the timing cycle of relay TDR is initiated. The timing cycle is selected so that, as long as the packages are passing through the section 34 at normal speed, the packages will release switch DS allowing it to open and interrupt the timing cycle before relay TDR times out. If a package is stopped in the section 34 as in the case of a jam so that it does not pass through at its normal speed, the switch DS remains closed allowing relay TDR to time out. This in turn causes contacts TDR-1 to open and disable master control relay MCR. As soon as the jam is cleared, the relay TDR is reset to restart the section 34.

The coil PR-C of a power relay PR is powered by subcircuit 132 through heat start switch HS, the normally open contacts MCR-5 of relay MCR and the normally open low pressure switch LP. Switch LP is operatively connected to the pressurized air supply to heater assemblies 101 and remains closed as long as the air pressure is sufficient to prevent element burnout (usually about 10 psi).

The heater element 131 in each heater assembly 101 is individually controlled. Thus, heater element 131 is powered from the 240 volt power source through double fuses SF, normally open power relay contacts PR-1 and PR-2, and adjustable temperature controller $TC_1$. Element $131_2$ is powered through double fuses SF, normally open contacts PR-3 and PR-4 and adjustable temperature controller $TC_2$. Each controller TC has an adjustment potentiometer AP therewith to change the voltage and thus the temperature output of elements 131.

From the foregoing, it will be seen the skirt bonding section normally operates continuously as soon as the operator closes switches PS, RS and HS, and momentarily closes start switch PB-2. If a jam occurs so that the relay TDR times out, the relays MCR and PR are disabled to stop operation of section 34. Also, the power relay PR will be disabled if air pressure is lost to prevent element burnout.

From the foregoing description of the skirt bonding section 34, it will be seen that the skirt portions 72 on the film sheet 14 pass just inside of the guide plates 95 so that the guide plates 95 and the primary welds $W_P$ hold the skirt portions 72 in juxtaposition with side walls 41. This locates the skirt portions 72 so that they pass first into registration with the heater cutouts 99. The heater assembly 101 is adjusted so that a hot air stream is directed against the skirt portion 72 to heat same. The major length of the air horn 107 is typically greater than the height of the skirt portion 72 and is rotated to an appropriate angle with respect to the vertical to achieve good skirt heat coverage. Typically, the air outlet temperature from heater assemblies 101 is set at about 1200°–1350° F. to heat the skirt portion 72 up to a temperature of about 250°–270° F. After the skirt portion 72 has been heated by the heater assemblies 101, the skirt portions 72 move into registration with the roller cutouts 100 so that the spring force from spring 26 urging the rollers 118 through the cutouts 100 will cause the rollers 118 to engage the skirt portions 72.

It will be appreciated that the height $h_{SR}$ of the roller 118 is such that all of the skirt portions 72 will be engaged by the rollers 118 and pressed against the side walls 41 to bond the skirt portions thereto. This bonding action flattens the skirt portions against the side walls 41 so that the effective transparency of the skirt portions 72 is enhanced. Typically, the roller height $h_{SR}$ is sufficient for the roller 118 to overlap the primary weld $W_P$ and also project below the skirt portion 72. By doing this, the primary weld $W_P$ will be pressed against side wall 41 to help prevent any weakening of each weld $W_P$ if it is heated by heater assembly 101 to a temperature sufficient to weaken weld $W_P$.

Figure 8:
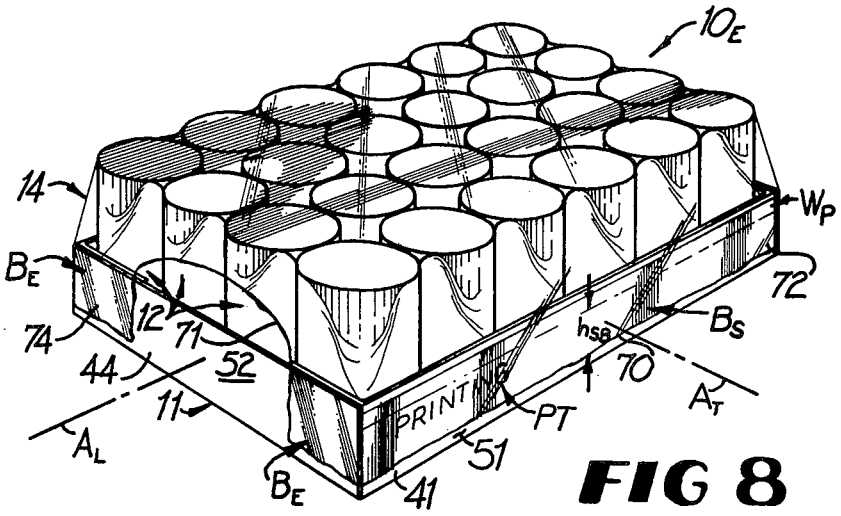
FIG. 8 is a perspective view illustrating the package of the invention after the skirt bond has been made.

It will likewise be appreciated that the side bonds $B_S$ do not have to be fiber-tearing bonds as the primary weld $W_P$ since the primary purpose of side bonds $B_S$ is to hold the skirt portions 72 down against the side walls 41. Typically, the height $h_{SB}$ of the skirt bonds $B_S$ is in the order of 1–1.5 inch as seen in FIG. 8. While not necessary, any fiber-tear strength achieved in the skirt bonds $B_S$ serves to increase the overall strength of the film/tray interface and thus enhance package integrity.

In summary, it will be seen that the primary weld $W_P$ needs to be a strong fiber tearing bond to prevent the film sheet 14 from being inadvertently separated from the tray side wall 41 so that package integrity is maintained. It will further be noted that the film sheet 14 at the primary weld $W_P$ is substantially co-planar with the outside surface 51 of the side wall 41. Since the force acting on the primary weld $W_P$ is substantially co-planar with the plane of the weld, the likelihood of weld failure is minimized. Typically, an adequate primary weld $W_P$ will be made by pressing the film sheet 14 against the side wall 41, where the side wall 41 is corrugated paperboard, sufficiently to press the corrugations about 1/16 inch. This usually requires a pressure of about 10–15 psi. The heating units 58 and 59 are typically maintained at a temperature of about 260°–300° F. while pressing the film against the tray. Good welds have been obtained under these conditions in about 3–4 seconds.

The basic package integrity is thus defined by the primary welds $W_P$ and it will be seen that the end bonds $B_E$ causing the end portions 71 of the film sheet 14 to adhere to the outside surfaces 52 of the end walls 44 and the side bonds $B_S$ adhering the outside surfaces 51 of the tray side walls 41 need not be fiber-tearing bonds since they are not carrying the primary load. Thus, it is not necessary to heat the film in these areas to the temperatures required for the primary welds. If these end and side bonds $B_E$ and $B_S$ are fiber-tearing bonds, however, the overall package integrity is increased. It has been found that the end bonds $B_E$ can be made immediately after the exit of the package $10_H$ from the shrink section 29 while the end portions 74 of the film are within a temperature range of 230°–250° F.

The skirt portions 72 of the film sheet 14 are usually not heated to a bonding temperature in the heat shrink section 29 so as not to weaken the primary welds $W_P$ during heat shrinking. The heater assemblies 101, while heating the skirt portions 72 to a bonding temperature of 250°–270° F. apply the heat on only a small area of the skirt portion 72 at the time before it is rolled down by the roller 118. This sequential heating followed by pressing the skirt portion 72 prevents the weld $W_P$ from deteriorating even if each section of the weld $W_P$ is momentarily raised to welding temperature as the package passes the heater assemblies 101. The side rollers 118 also typically apply a compressing pressure of about 2–5 psi to insure bonding between the skirt portion 72 and tray side wall 41.

What is claimed as invention is:

1. A multi-unit package comprising:

a cellulosic tray including a bottom wall and a pair of spaced apart upstanding side walls along opposite sides of the bottom wall;

a group of articles on said bottom wall between said side walls; and a flexible film sheet extending over said group of articles and overlapping said tray side walls, said film sheet overlying said side walls of said tray to form a skirt and bonded with heat and pressure to each of said tray side walls by its own substance with a primary bond extending along the length of said side wall, the primary bond having a height less than the height of said walls and located adjacent that edge of said side wall opposite said bottom wall and with a skirt bond bonding that skirt portion of said film sheet between said primary bond and the edge of said film sheet along the length of said side wall, the skirt bond having been made subsequent to the primary bond by sequentially heating and pressing said skirt portion against said tray side wall so that the section of said skirt portion raised to bonding temperature at any one time has a length less than the length of said tray side walls.

2. The multi-unit package of claim 1 wherein said film sheet is heat shrinkable, said film sheet having been heat shrunk over the group of articles after formation of said primary bond to cause said film sheet to lock said articles in place in said tray.

3. The multi-unit package of claim 2 wherein said cellulosic tray includes a pair of spaced apart upstanding end walls along opposite ends of the bottom wall and wherein said flexible film sheet further overlaps at least a portion of said tray end walls, said film sheet overlapping said tray end walls having been bonded to said end walls.

4. A method of forming a multi-unit package comprising the steps of:

(a) moving an open top cellulosic tray with a pair of upstanding side walls along opposite sides thereof along a prescribed path with the tray loaded with a group of articles;

(b) placing a film sheet over the articles in the trays;

(c) while maintaining the film sheet over the articles in the tray, primarily bonding the film sheet to the outside of the tray side walls while leaving unattached skirt portions between the primary bond and the edges of the film sheet; and (d) sequentially heating and pressing the skirt portions of the film sheet against the outside of the tray side walls lengthwise of the tray side walls so that the section of the skirt portion raised to bonding temperature at any one time has a length less than the length of the tray side walls and the primary bonds to cause the skirt portion to be bonded to the outside of the tray side walls.

5. The method of claim 4 wherein step (c) is performed by pressing and heating the film sheet against the tray side walls for a sufficient length of time to cause the material of the film to form a strong fiber-tearing bond with the tray side walls.

6. The method of claim 5 wherein step (d) further includes sequentially pressing those portions of the film sheet at the primary bonds against the tray side walls along with the pressing of the skirt portions against the tray side walls.

7. The method of claim 5 further comprising the step of heat shrinking the film sheet after step (c).

8. The method of claim 7 further comprising the step of bonding those portions of the film sheet overlapping the end walls of the tray thereto.

9. The method of claim 8 further including the step of cooling the film sheet after the step of heat shrinking the film and before step (d).

10. The method of claim 9 further including the step of turning the tray so that the tray is moving along its longitudinal axis after step (c) and before step (d).

11. The method of claim 10 wherein step (d) includes heating the skirt portion of the film sheet to a temperature of about 230°–250° F. and pressing the skirt portions against the tray side walls with a pressure of about 2–5 psi.

12. Apparatus for forming a multi-unit package from an article filled open top cellulosic tray with a pair of upstanding side walls along opposite sides thereof and a film sheet including:

conveying means for moving the article filled tray along a prescribed path;

unwinder means for placing the film sheet over the articles in the tray;

compression means for folding the film sheet over opposite sides of the group of articles so that the film sheet overlies the upstanding side walls of the tray while holding the film sheet taut;

heating means for heating a portion of the film in juxtaposition with the side walls of the tray for a prescribed length of time and under a prescribed pressure to cause the film sheet to form a primary bond with the side wall of the tray;

separating means separating the film between the trays to form unattached skirt portions along opposite sides of the film sheet below the primary bond and skirt bonding means for heat bonding the skirt portions of the film sheet between the primary bond and the edge of said film sheet to the side walls of the cellulosic tray, said skirt bonding means including heating means for sequentially heating the skirt portions to bonding temperature along the length thereof so that that section of each skirt portion raised to bonding temperature at any one time has a length less than the length of the skirt portion, and pressing means for sequentially pressing the skirt portions against the tray side walls while each section of the skirt portion is at bonding temperature.

13. The apparatus of claim 12 wherein said skirt bonding means further includes guide means for maintaining the skirt portions of the film sheet adjacent the tray side walls while the skirt portions are being heated by said heating means.

14. The apparatus of claim 12 wherein said pressing means is sized to sequentially press said skirt portions and those portions of the film sheet already bonded to the side walls of the tray by the primary heat weld.

15. The apparatus of claim 12 wherein said heating means is sized to heat an area shorter than the length of the tray side walls and wherein said conveying means moves the tray past said heating means to sequentially heat the skirt portion of the film sheet along the length thereof.

* * * * *